US006019448A

United States Patent [19]

Yano et al.

[11] Patent Number: 6,019,448

[45] **Date of Patent: *Feb. 1, 2000**

[54] METHOD AND APPARATUS FOR SUB-DIVIDING BLOCKS

[75] Inventors: Kentaro Yano; Naoji Otsuka, both of Yokohama; Osamu Iwasaki, Kawasaki; Daigoro Kanematsu, Yokohama, all of Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/518,453

[22] Filed: Aug. 23, 1995

[30] Foreign Application Priority Data

Aug. 24, 1994 [JP] Japan ..... 6-199829
Aug. 3, 1995 [JP] Japan ..... 7-198469

[51] Int. Cl.[7] ..... B41J 29/38

[52] U.S. Cl. ..... 347/12; 347/180

[58] Field of Search ..... 347/9–13, 180–182

[56] References Cited

U.S. PATENT DOCUMENTS

| | | | |
|---|---|---|---|
| 4,313,124 | 1/1982 | Hara . | |
| 4,345,262 | 8/1982 | Shirato et al. . | |
| 4,459,600 | 7/1984 | Sato et al. . | |
| 4,463,359 | 7/1984 | Ayata et al. . | |
| 4,558,333 | 12/1985 | Sugitani et al. . | |
| 4,608,577 | 8/1986 | Hori . | |
| 4,723,129 | 2/1988 | Endo et al. . | |
| 4,740,796 | 4/1988 | Endo et al. . | |
| 5,173,717 | 12/1992 | Kishida et al. | 346/1.1 |
| 5,280,310 | 1/1994 | Otsuka et al. . | |
| 5,305,024 | 4/1994 | Moriguchi et al. | 346/140 R |
| 5,339,099 | 8/1994 | Nureki et al. | 346/76 |
| 5,442,381 | 8/1995 | Fukubeppu et al. | 347/18 |
| 5,452,095 | 9/1995 | Ono et al. | 358/296 |
| 5,477,246 | 12/1995 | Hirabayashi et al. | 347/12 |
| 5,539,433 | 7/1996 | Kawai et al. | 346/141 |
| 5,559,535 | 9/1996 | Otsuka et al. | 347/14 |
| 5,581,281 | 12/1996 | Fuse | 347/14 |
| 5,594,478 | 1/1997 | Matsubara et al. | 347/41 |

FOREIGN PATENT DOCUMENTS

| | | |
|---|---|---|
| 0440490 | 8/1991 | European Pat. Off. . |
| 0630751 | 12/1994 | European Pat. Off. . |
| 54-056847 | 5/1979 | Japan . |
| 59-123670 | 7/1984 | Japan . |
| 59-138461 | 8/1984 | Japan . |
| 60-071260 | 4/1985 | Japan . |

*Primary Examiner*—Safet Metjahic
*Assistant Examiner*—John Chizmar
*Attorney, Agent, or Firm*—Fitzpatrick, Cella, Harper & Scinto

[57] ABSTRACT

When a recording mode of a printer is changed to a resolution expansion mode when an internal temperature of a recording head falls or by an external indication, the number of divided blocks is changed so that the overlap of on time zones of block sub-division signals is prevented in order to assure that heaters of the recording head are energized for a sufficient time period. Thus, the heater energization time period for each block is extended without extending the total recording time.

17 Claims, 14 Drawing Sheets

FIG. 5

| | BENB0 | BENB1 |
|---|---|---|
| 1st | NOZZLES 1, 5, 9, 13 | NOZZLES 3, 7, 11, 15 |
| 2nd | NOZZLES 2, 6, 10, 14 | NOZZLES 4, 8, 12, 16 |

FIG. 10

[UNIT: μs]

| NO. | setup (1st) | setup (2nd) | pre | off | main |
|---|---|---|---|---|---|
| 1 | 2 | 8 | 1 | 0 | 3 |
| 2 | 1 | 7 | 1 | 1 | 3 |
| 3 | 0 | 6 | 1 | 2 | 3 |
| 4 | 2 | 5 | 1 | 3 | 3 |
| 5 | 1 | 4 | 1 | 4 | 3 |
| 6 | 0 | 3 | 1 | 5 | 3 |

METHOD AND APPARATUS FOR SUB-DIVIDING BLOCKS

BACKGROUND OF THE INVENTION

1. Field of the Invention

The present invention relates to recording method and apparatus, and more particularly to recording method and apparatus using an ink jet type recording head.

2. Related Background Art

Office Automation equipment such as personal computers and word processors have recently been popular widely and various recording apparatuses for printing out information inputted by such equipment and technologies to increase the speed of the recording apparatus and enhance the image quality have been developed rapidly. Typical examples of increasing the recording speed are the increase of the number of recording elements of the recording head and the control of block drive of the recording elements to efficiently drive the increased number of recording elements.

FIG. 11 illustrates the prior art block drive control of the recording elements of the recording head. In FIG. 1, n1, n2, . . . , n16 denote ink discharge nozzles of a recording head of an ink jet type and each nozzle is provided with a recording element therein. An image is recorded on a recording medium by ink droplets discharged from the respective nozzles. A dot formed by each ink droplet is called a record pixel. Usually, the number of nozzles provided in one recording head is 50 to several hundreds although FIG. 11 shows the recording head having 16 nozzles to simplify the drawing. In FIG. 11, lines drawn vertically at an equal interval represent a pitch (recording pitch) of the record pixels. For example, in a recording head having a recording density of 360 DPI (dots per inch), the pitch is approximately 71 $\mu$m.

The nozzles of the recording head shown in FIG. 11 are arranged such that a direction of arrangement of the nozzles is oblique to a direction of feed of a recording sheet (medium) and the recording head is mounted on a printer at such an angle that an interval between the nozzle 1 (n1) and the nozzle 5 (n5) is just the recording pitch. The recording head scans on the recording medium to record the record pixels in accordance with the record data to form a record image. For example, when one-dot line is to be recorded in a column shown by an arrow designated by "record column" in FIG. 11, the recording element corresponding to the nozzle 1 (n1) is driven when the recording head comes to the position "1" in FIG. 11, and then the recording element corresponding to the nozzle 2 (n2) is driven when the recording head comes to the position "2", and similarly the recording element corresponding to the nozzle 16 (n16) is driven when the recording head comes to the position "16" so that the vertical one-dot line as shown in FIG. 11 is recorded.

In the recording head described above, taking the recording pitch into consideration, the nozzle 1 (n1), nozzle 5 (n5), nozzle 9 (n9) and nozzle 13 (n13) are grouped in one block because they are requested to conduct the record operation concurrently, and similarly the nozzle 2 (n2), nozzle 6 (n6), nozzle 10 (n10) and nozzle 14 (n14) are grouped in another block, the nozzle 3 (n3), nozzle 7 (n7), nozzle 11 (n11) and nozzle 15 (n15) are grouped in yet another block, and the nozzle 4 (n4), nozzle 8 (n8), nozzle 12 (n12) and nozzle 16 (n16) are grouped in a further block.

Namely, in the recording head of the above construction, since the concurrent drive of more than four nozzles does not occur, a cost is reduced by the decrease of a power supply capacity, compared to a case where all of the sixteen nozzles of the recording head are to be concurrently driven. Further, by arranging the recording elements across the plurality of record pitches a recording density of the record dots increases and a high grade record image is attached, compared to a case where the nozzles of the recording head are arranged vertically to a direction of movement of the recording head and all nozzles are concurrently driven to record one-dot line.

As means to attain the high grade image, a PWM drive control, for example, may be conducted in which a drive pulse to record one pixel is formed by a multiple of pulses as shown in FIG. 12 and a pulse width is modulated in accordance with a state of the recording head.

Further, technology to expand the resolution such as a smoothing process to expand in the recording apparatus the resolution of record data sent from an external apparatus such as a personal computer has been developed and put into practical use.

However, the high speed control and the high image quality control in the prior art are competing to each other.

For example, when the number of recording elements is doubled to double the recording speed, the number of blocks to be driven in one drive period increases when the number of concurrently driven nozzles is constant. As a result, when eight blocks are to be division-driven by a 6 KHz drive pulse, a drive time of approximately 20 $\mu$s may be allocated to one block, but when 16 blocks are division-driven, a drive time of only 10 $\mu$s is allocated to the drive pulse. Similarly, when the drive pulse frequency is to be doubled, the period of the drive pulse is halved and the same problem arises.

This is considered for a recording head having 128 nozzles by taking into consideration the number of nozzles of the recording head actually mounted on the printer (approximately 50 to 128). Assuming that the number of concurrently driven nozzles is 8 and the drive frequency is 160 $\mu$s as they are for the recording head having 16 nozzles, the number of blocks is 16 and the heater drive time per block should be set to shorter than 10 $\mu$s. Further, when the double resolution expansion control described above is to be conducted under this condition (for example, the recording resolution is to be expanded from 360 DPI to 720 DPI), the resolution in a main scan direction of the recording head is doubled (the recording pitch is halved or the number of columns per unit length is doubled) and the number of pixels to be recorded in a given time is doubled. As a result, the heater drive time per block should be set to shorter than 5 $\mu$s. When the heater drive time is short, it is difficult to apply to the heater even a minimum thermal energy to cause bubbling of ink.

The pulse width modulation drive for correcting the ink discharge amount for high grade image or the recording head drive control for the multi-value image data recording may be attained without the resolution expansion control if the heater drive time is set to shorter than 10 $\mu$s. But, the drive time is not sufficiently long and the setting of a longer drive time is desired. Thus, in order to attain the pulse width modulation control for the high grade image, the longer permissible drive pulse width is desired, which is contrary to the high speed requirement.

In the multi-value image which is considered to be a main technology in the future high grade image technology, it is necessary that the drive pulse is wide.

On the other hand, if the number of concurrently driven nozzles can be increased, the number of divided groups decreases and the heater drive time per group may be theoretically extended without changing a total record time. However, the number of concurrently driven nozzles has an upper limit when the requirements to reduce a capacity of a power supply or the stabilization of the voltage to be applied to the recording elements (heaters) are taken into consideration. Namely, it is desired to increase the number of concurrently driven nozzles without increasing the drive load.

For example, when a heat generating resistor which is a 119 Ω heater is driven by a 24-volt power supply, a current of approximately 200 mA flows per nozzle assuming that a resistive component for causing a voltage drop such as a wiring resistance is approximately 1 Ω. In this case, assuming that the heat generating resistors are connected in parallel to the drive power source and the wiring resistance for each heat generating resistor is connected in series to the drive power source and also that the number of concurrently driven recording elements is eight, a maximum current is 1600 mA. When the numbers of concurrently driven recording elements are one and eight, the voltage drops due to the voltage drop factors are 0.2 volt and 1.6 volts, respectively, and the power supply voltages applied to the heater are 23.8 volts and 22.4 volts, respectively. When the maximum number of concurrently driven recording elements is 16, the voltage drop due to the voltage drop factor increases to 3.2 volts from 0.2 volt for the one concurrently driven recording element and the power supply voltage applied to the heater decreases to 20.8 volts from 23.8 volts. If the drive condition (pulse width) is set to assure the sufficient discharge of the ink with the applied power supply voltage of 20.8 volts, the equivalent pulse is applied to the power supply of 23.8 volts and a load to certain heat generating resistor increases and the reliability and durability thereof are damaged.

By this reason, the number of concurrently driven recording elements is limited.

Further, it may be theoretically possible to drive the heater by a high voltage above 30 volts, for example, to reduce the pulse width. However, even with this method, an unlimitedly high voltage power supply cannot be used when a property of the transistor driver for driving the heater and a production cost of the recording head are taken into consideration. Further, when the high voltage drive is used, a high current flows through the transistor, the heater and the surrounding wiring resistance, the voltage drop due to the voltage drop factor increases and a variation of the power supply voltage applied to the heater increases.

In addition, it is apparent that the number of recording elements of the recording head and the drive period therefor will be reduced in order to enhance the quality of the recorded image and the resolution, so the coordination between the satisfaction of such requirement and the limit of the number of concurrently driven recording elements will be more and more difficult.

There are various techniques to realize the high grade image and it is not limited to the technology to control the pulse width to drive the recording head. But the high speed control technology and the high grade image technology are in an intimate relation from standpoints of both the stable use of the recording head and the most direct technology to control the record pixels.

SUMMARY OF THE INVENTION

It is an object of the present invention to provide recording method and apparatus which are compatible to the high speed image recording and the high grade image.

It is another object of the present invention to provide recording method and apparatus which can increase the number of concurrently driven recording elements without increasing the drive load.

In order to achieve the above objects, in accordance with one aspect of the present invention, there is provided a recording apparatus having a recording head for recording an image by dividing a plurality of recording elements into a plurality of blocks and driving the recording elements belonging to the same block substantially concurrently, comprising generation means for generating a plurality of pulse control signals having different timings to drive the recording elements belonging to the same block for each of said blocks, and drive means for driving the recording elements belonging to the same block for each of said blocks in accordance with said pulse control signals. The generation means switches a drive timing by said pulse control signals.

In accordance with another aspect of the present invention, there is provided a recording method for controlling a recording head for recording an image by dividing a plurality of recording elements into a plurality of blocks and driving the recording elements belonging to the same block substantially concurrently, comprising the steps of generating a plurality of pulse control signals having different timings to drive the recording elements belonging to the same block for each of said blocks; and driving the recording elements belonging to the same block for each of said blocks in accordance with said pulse control signals. The generation step switches a drive timing by said pulse control signals.

In accordance with other aspect of the present invention there is provided a recording apparatus having a recording head for recording an image by dividing a plurality of recording elements into a plurality of blocks and driving the recording elements belonging to the same block substantially concurrently, comprising division means for dividing each of said blocks into periods in which a plurality of recording elements belonging to the same block for each of said blocks are driven at different timings, and drive means for driving the recording elements belonging to the same block for each of said blocks in accordance with the period divided by said division means. The division means divides said blocks by a plurality of specifications, the periods divided by the plurality of specifications not overlapping to each other.

In accordance with a further aspect of the present invention, there is provided a recording method for controlling a recording head for recording an image by dividing a plurality of recording elements into a plurality of blocks and driving the recording elements belonging to the same block substantially concurrently, comprising the steps of dividing each of said blocks into periods in which a plurality of recording elements belonging to the same block for each of said blocks are driven at different timings, and driving the recording elements belonging to the same block for each of said blocks in accordance with the period divided by said dividing step. The dividing step divides said blocks by a plurality of specifications, the periods divided by the plurality of specifications not overlapping to each other.

In accordance with the present invention, a specification of block division may be readily changed in accordance with a print mode as required so that the high speed image recording and the high grade image are compatible.

Further, in accordance with the present invention, even when the specification of the block division is changed, the number of concurrently driven recording elements can be increased without increasing the drive load.

BRIEF DESCRIPTION OF THE DRAWINGS

FIG. 5 shows a relation between a nozzle for discharging ink droplet and block division signals (BENB0, BENB1) and block sub-division signals (1st, 2nd), FIG. 10 shows signal characteristics of various block sub-division signals (1st, 2nd) in accordance with a third embodiment.

DETAILED DESCRIPTION OF THE PREFERRED EMBODIMENTS

Preferred embodiments of the present invention are now explained in detail with reference to the accompanying drawings.

Common Embodiment

Figure 1:
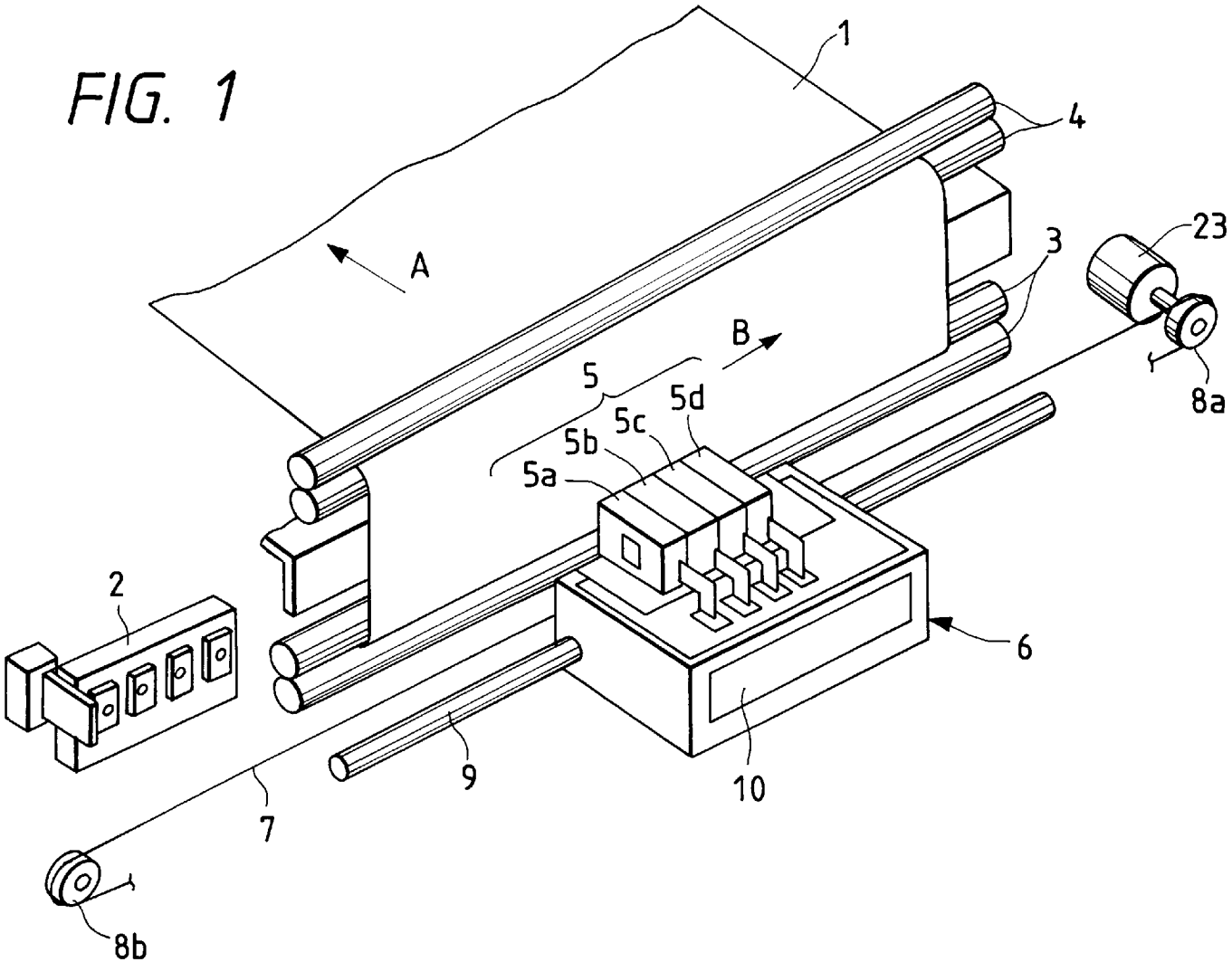
FIG. 1 shows an external view of an ink jet type printer apparatus which is a representative embodiment of the present invention.

FIG. 1 shows an external perspective view of an ink jet type printer apparatus which is a representative embodiment of the present invention. In FIG. 1, numeral 1 denotes a record sheet such as paper or plastic sheet. Record sheet 1 stacked on a sheet feed cassette (not shown) are fed, one at a time, by a sheet feed roller (not shown) and fed in a direction shown by an arrow A by a feed roller pair 3 and a feed roller pair 4 which are disposed at a predetermined space and driven by a stepping motor (not shown).

Numeral 5 denotes an ink jet type recording head for recording an image on the record sheet 1. Ink required for the recording is supplied from an ink cartridge 10 and ink droplets are discharged from nozzles of the recording head in accordance with the image signal. The recording head 5 and the ink cartridge 10 are mounted on a carriage 6 to which a carriage motor 23 is linked through a belt 7 and pulleys 8*a* and 8*b*. Accordingly, the carriage 6 reciprocally scans along a guide shaft 9 by the drive by the carriage motor 23.

By this arrangement, the recording head 5 is moved along an arrow B direction and discharges the ink to the record sheet 1 in accordance with the image signal to record the image. The recording head 5 removes the clogging of the nozzles by a recovery device 2 provided at a home position as required and the feed roller pairs 3 and 4 drive the record sheet 1 along the arrow A direction by an image width corresponding to the image recorded by one scan of the carriage. By repeating the above, a desired record is formed on the record sheet 1.

A control unit for controlling the drive of respective elements of the printer apparatus is now explained.

Figure 2:
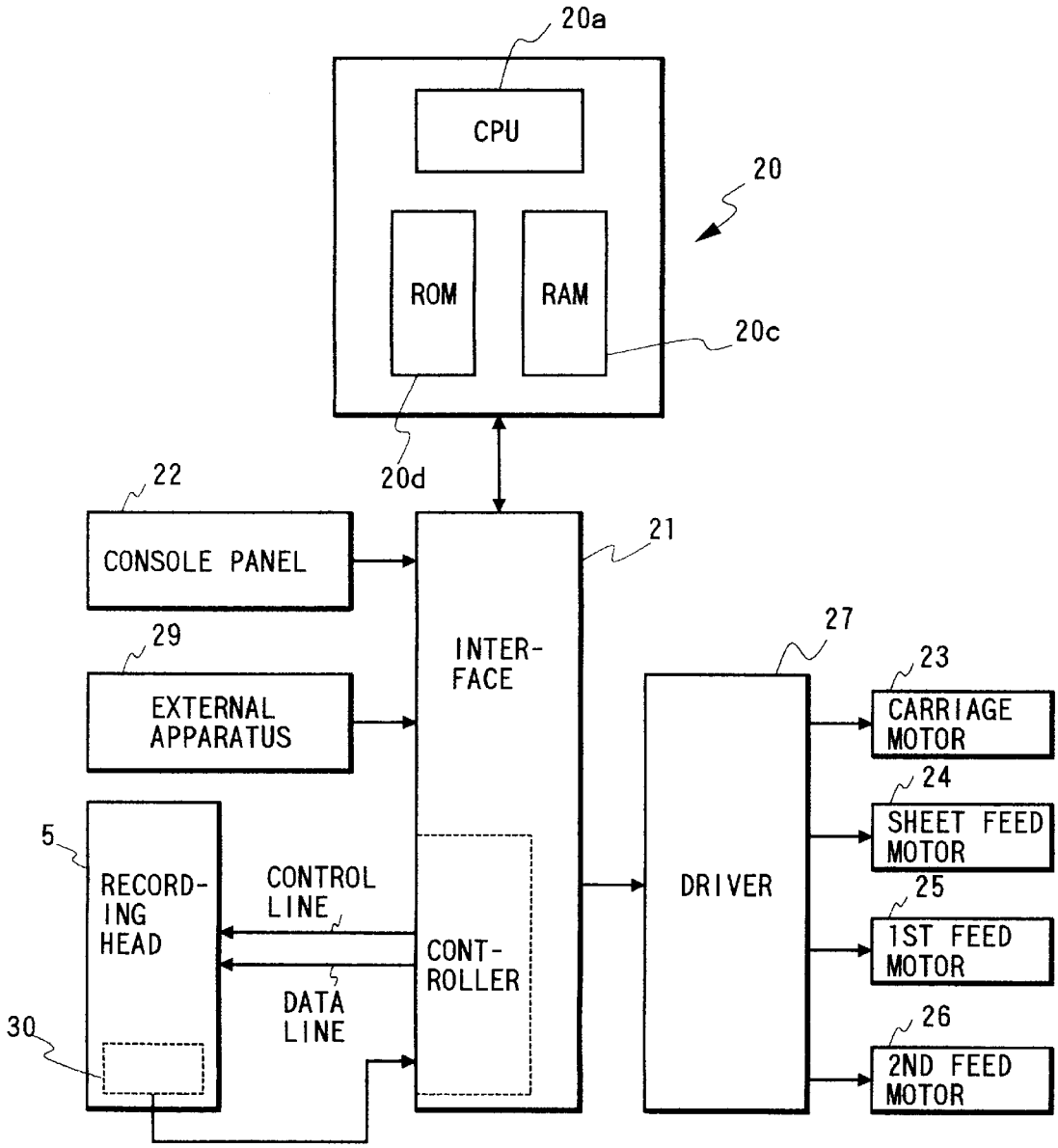
FIG. 2 shows a block diagram of a configuration of a control unit for driving respective elements of the printer apparatus.

FIG. 2 shows a block diagram of a configuration of the control unit. As shown in FIG. 2, the control unit comprises a control circuit 20 including a CPU 20*a* such as a microprocessor, a ROM 20*b* for storing control programs of the CPU 20*a* and various data and a RAM 20*c* used as a work area of the CPU 20*a* and to temporarily store various data, an interface 21, a console panel 22, a carriage drive motor (carriage motor) 23, a sheet feed motor (feed motor) 24, a motor (first feed motor) 25 for driving the feed roller pair 3, a motor (second feed motor) 26 for driving the feed roller pair 4 and a driver 27 for driving the four motors 23–26.

A temperature sensor 30 is built in the recording head 5 to continuously monitor an internal temperature of the recording head 5. A control line and a data line extend from a controller in the interface 21 to the recording head 5, and temperature information measured by the temperature sensor 30 is received by the controller and sent to the control circuit 20. The controller controls the recording operation by a control signal sent to the recording head through a control line. The control circuit 20 controls the recording operation of the recording head 5 in accordance with the temperature information.

The control unit 20 controls the recording operation in accordance with various information (for example, character pitch and character type) and a recording mode (normal mode or resolution expansion mode) inputted from the console panel 22 through the interface 21. The control unit 20 receives an image signal from an external device 29 such as a host computer and outputs an ON/OFF signal to drive the motors 23 to 26 through the interface 21 to drive the respective elements, and generates a pulse signal to be described later and drives the recording head 5 through the controller in accordance with the input image signal to conduct the recording operation.

In the present embodiment, it is assumed that the recording head having 16 nozzles and the resolution of 360 DPI when the recording mode is in the normal mode is block-divided to drive it at 6.25 kHz. The resolution expansion mode is a recording mode in which the resolution of the record image sent from the external device such as a personal computer is expanded by a factor of two to conduct a smoothing process for the image to enhance the image grade. Since the resolution expansion smoothing control has been known, the explanation of this control is omitted.

First Embodiment

A record control of the recording head using a block division signal and a block sub-division signal from subdividing the signal is explained.

Figure 3A:
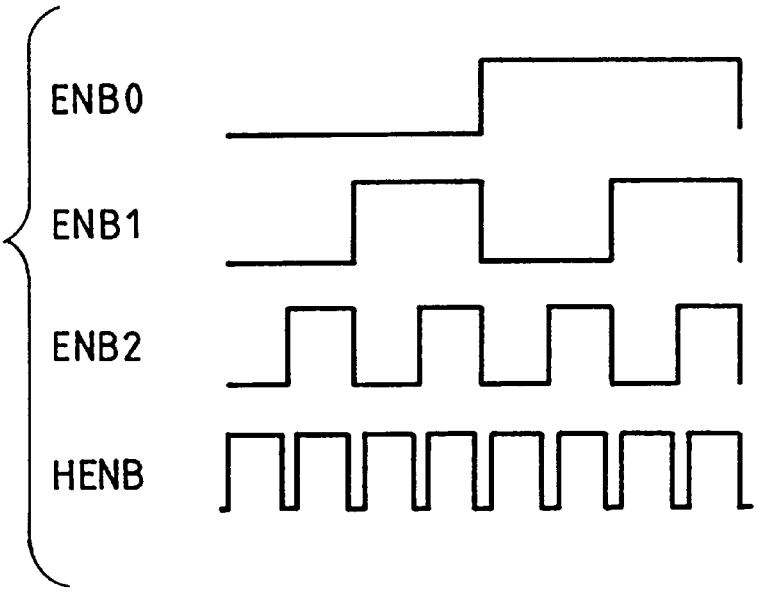
FIG. 3A PRIOR ART
FIGS. 3A and 3B show block selection signals to divide recording elements of a recording head into eight blocks.
Figure 3B:
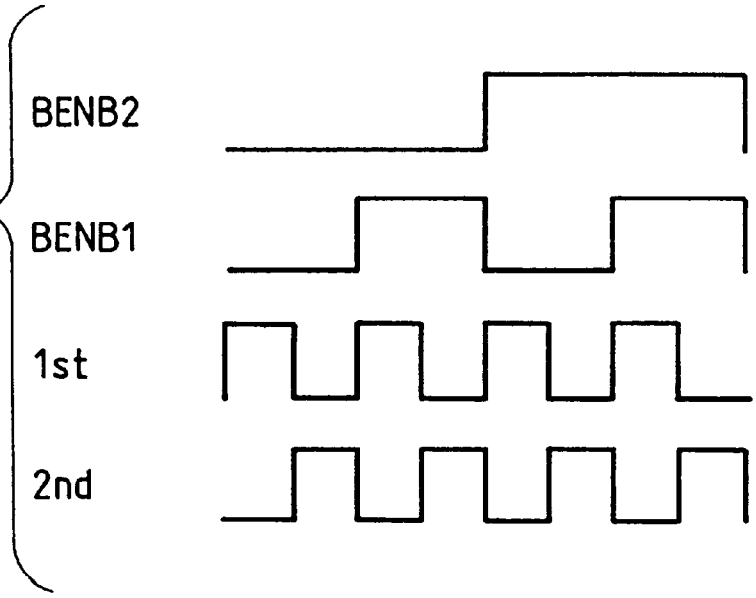

In a prior art block selection method for driving the recording elements of the recording head to eight blocks, it is common, as shown in FIG. 3A, to transfer 3-bit information (ENB2 to ENB0) from the printer apparatus to the recording head. The 3-bit information is decoded in the recording head into eight types of signals 0 to 7 to gate heat signals (HENB) to drive the respective blocks. However, the number of division blocks may be increased by using the sub-division method in which, as shown in FIG. 3B, 2-bit information (BENB1 and BENB2) is transferred from the printer apparatus to the recording head and it is divided into four types of signals 0 to 3 in the recording head, and each block is sub-divided by a plurality of (two in the present embodiment) signal lines (1st and 2nd) as shown in FIG. 3B. Accordingly, in the present embodiment, in order to allow that the number of blocks selected is changed to any number, the signal lines to sub-divide the blocks are provided. In the present embodiment, the heat signals of the prior art as well as the sub-division signal lines 1st and 2nd are used.

Figure 14:
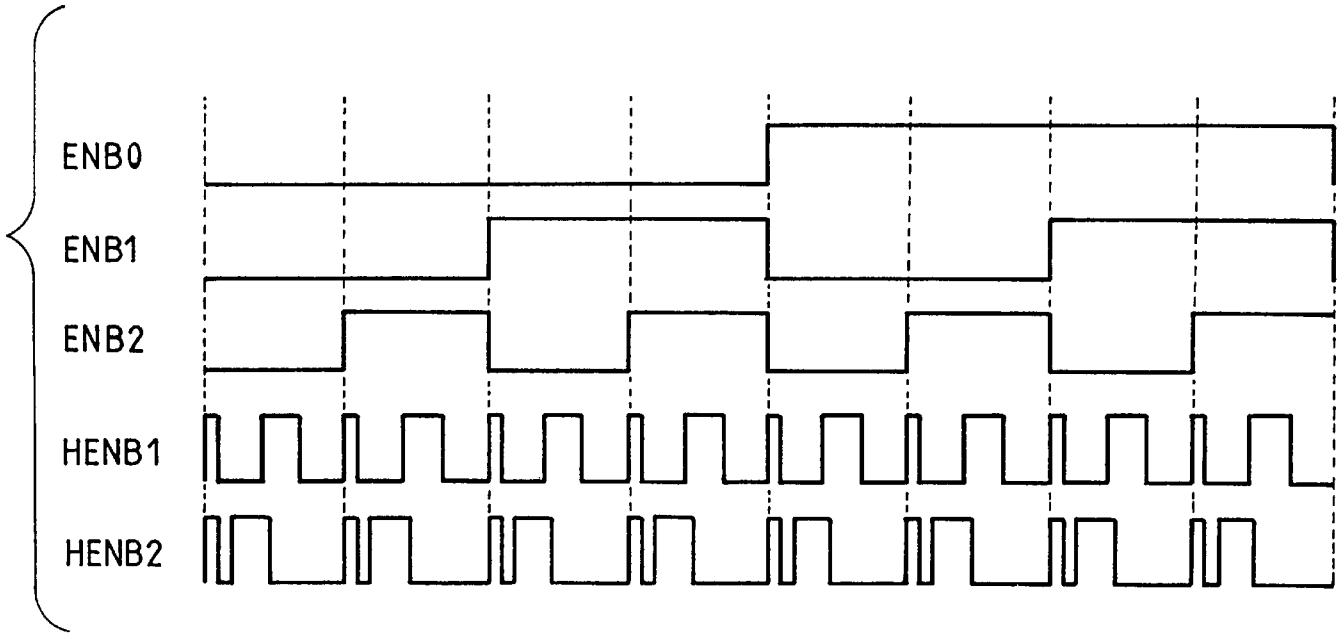
FIG. 14 PRIOR ART
FIG. 14 shows a timing chart of detail of prior art block drive control, FIGS. 15A and 15B each show a timing chart of block control in a normal mode in the present invention, and FIGS. 16A and 16B each show a timing chart of block drive control in a resolution expansion mode in the present invention.

FIG. 14 shows a timing chart when the prior art block division method is applied to a pulse width modulation method. In FIG. 14, a heat signal HENB1 represents that an off time of a double pulse is long, and a heat signal HENB2 represents that the off time of the double pulse is short.

Figures 15A, 15B:
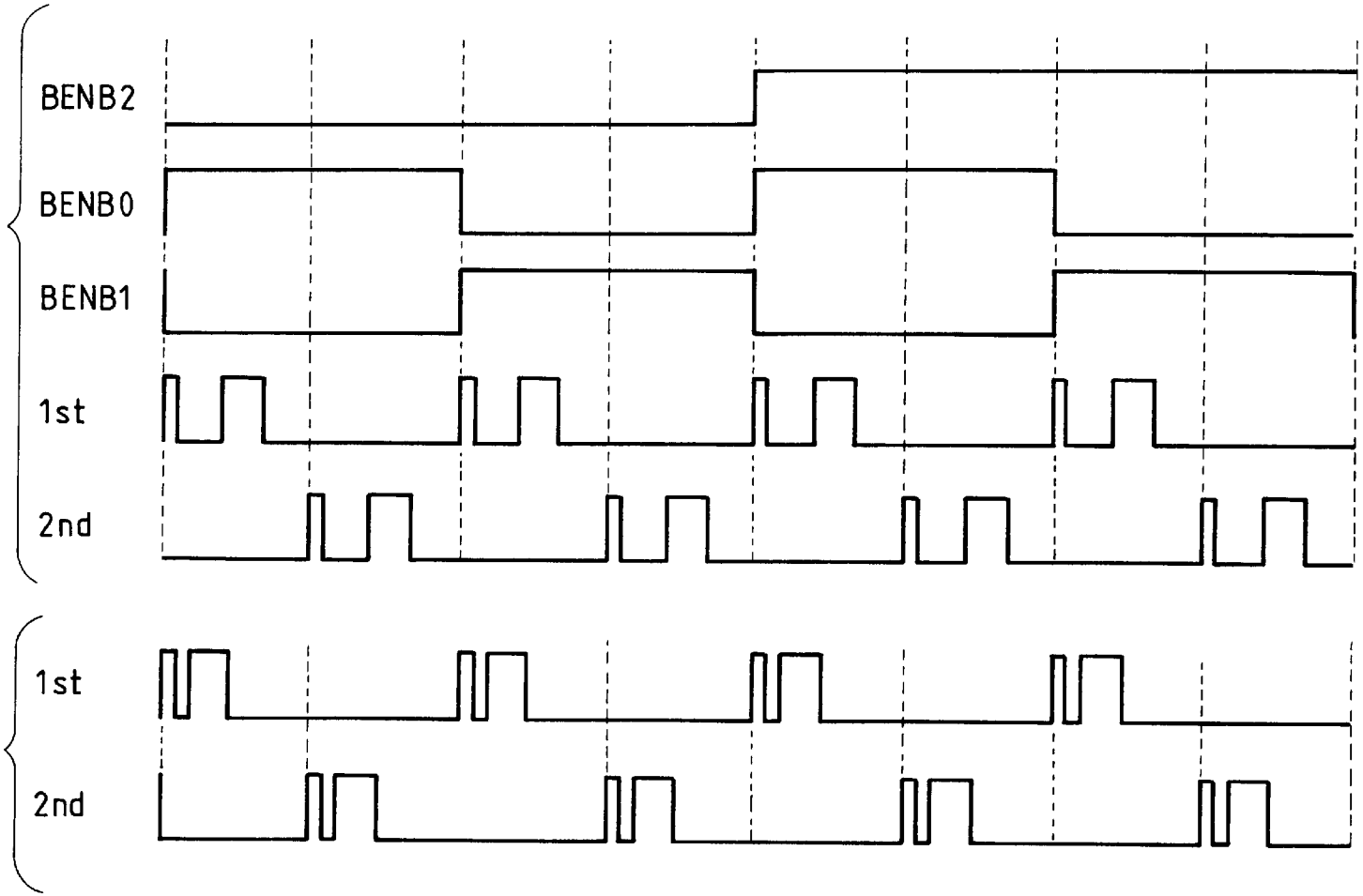

FIGS. 15A and 15B show each a timing chart when a block division method of the present embodiment is applied to the pulse width modulation method. In the drawing, a block enable signal BENB0 is a polarity inversion of an enable signal BENB1 and it gates the block sub-division signal 1st. On the other hand, the enable signal BENB1 gates the block sub-division signal 2nd. The sub-division signals 1st and 2nd also function as the heat signals as described above. In FIG. 15A, the off time of the double pulse is long, and in FIG. 15B, the off time is short.

It is now assumed that the resolution expansion control with the factor of two is conducted. In this case, as described above, in order to maintain the recording speed, it is necessary to double the pulse frequency, that is, halve the pulse period, or to double the number of concurrently drive frequency without increasing the drive load. As seen from FIG. 14, in the prior art division method, it is possible to halve the pulse period of the heat signal HENB2 which has a short pulse period but it is not possible to half the pulse period of the heat signal HENB2 which has a long pulse period.

Figures 16A, 16B:
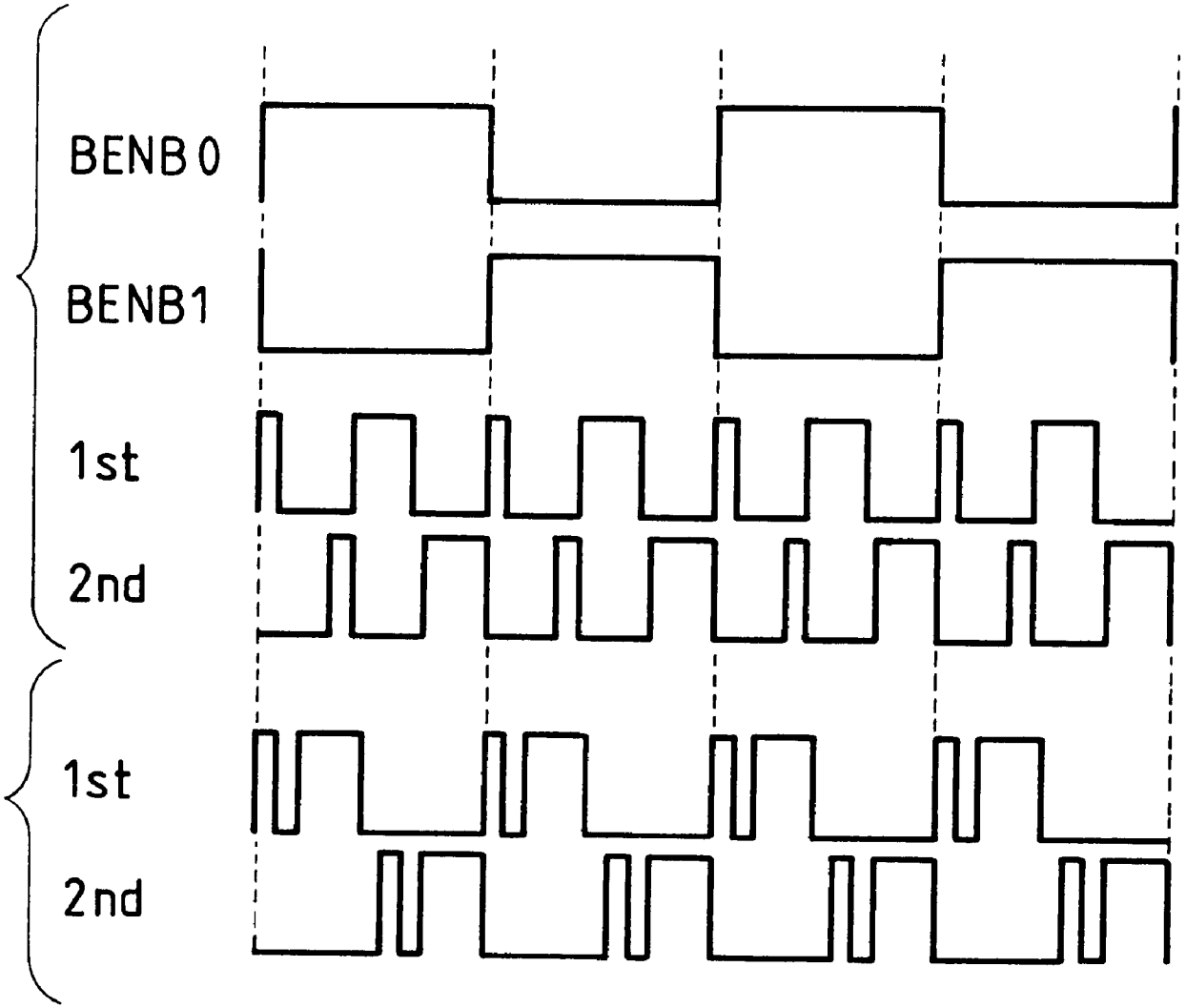

On the other hand, in the present embodiment, the resolution expansion control is attained as shown in FIGS. 16A and 16B. Namely, for a case of FIG. 16A where the pulse period is long, the number of divided blocks is decreased without increasing the drive load to double the concurrent drive frequency, and for a case of FIG. 16B where the pulse period is short, the pulse period is halved.

Figure 4:
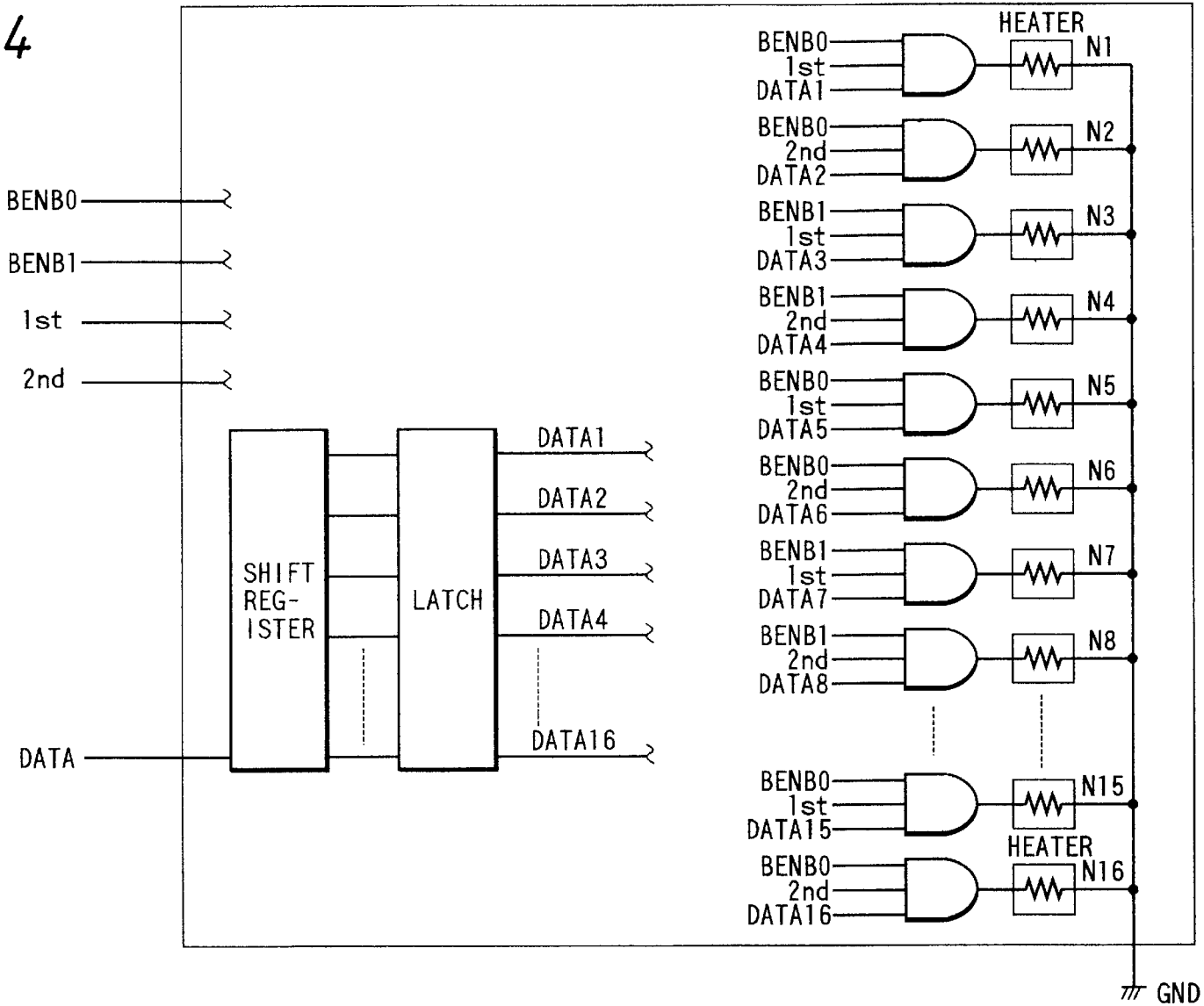
FIG. 4 shows a block diagram of a logical configuration to drive the recording head.

FIG. 4 shows a block diagram of a logical configuration to drive the recording head. A configuration to provide a signal line for the block sub-division to change the number of divided blocks is now explained in detail.

For the simplicity of the explanation, the block enable signal BENB2 for selecting the block is omitted and the maximum number of divided blocks is set to four. The number of recording elements is set to 16. Heaters N1 to N16 corresponding to the 16 recording elements are energized when three types of signals, the two block enable (division) signals (BENB0, BENB1) for selecting the blocks, the block sub-division signals (1st, 2nd) for sub-dividing the individual blocks and the 16 data signals (DATA1, DATA2, . . . , DATA16) for transmitting the data image signals are at the "H" (high) level. The data signals (DATA1, DATA2, . . . , DATA16) are transferred from the control unit of the printer apparatus through a driver circuit 28 and applied to a shift register in the recording head, and then latched in a latch circuit and applied to one of input terminals of an AND gate connected to the heaters N1 to N16. The block signals (BENB0, BENB1) and the block sub-division signals (1st, 2nd) are supplied from the controller through the control line shown in FIG. 2.

Figure 11:
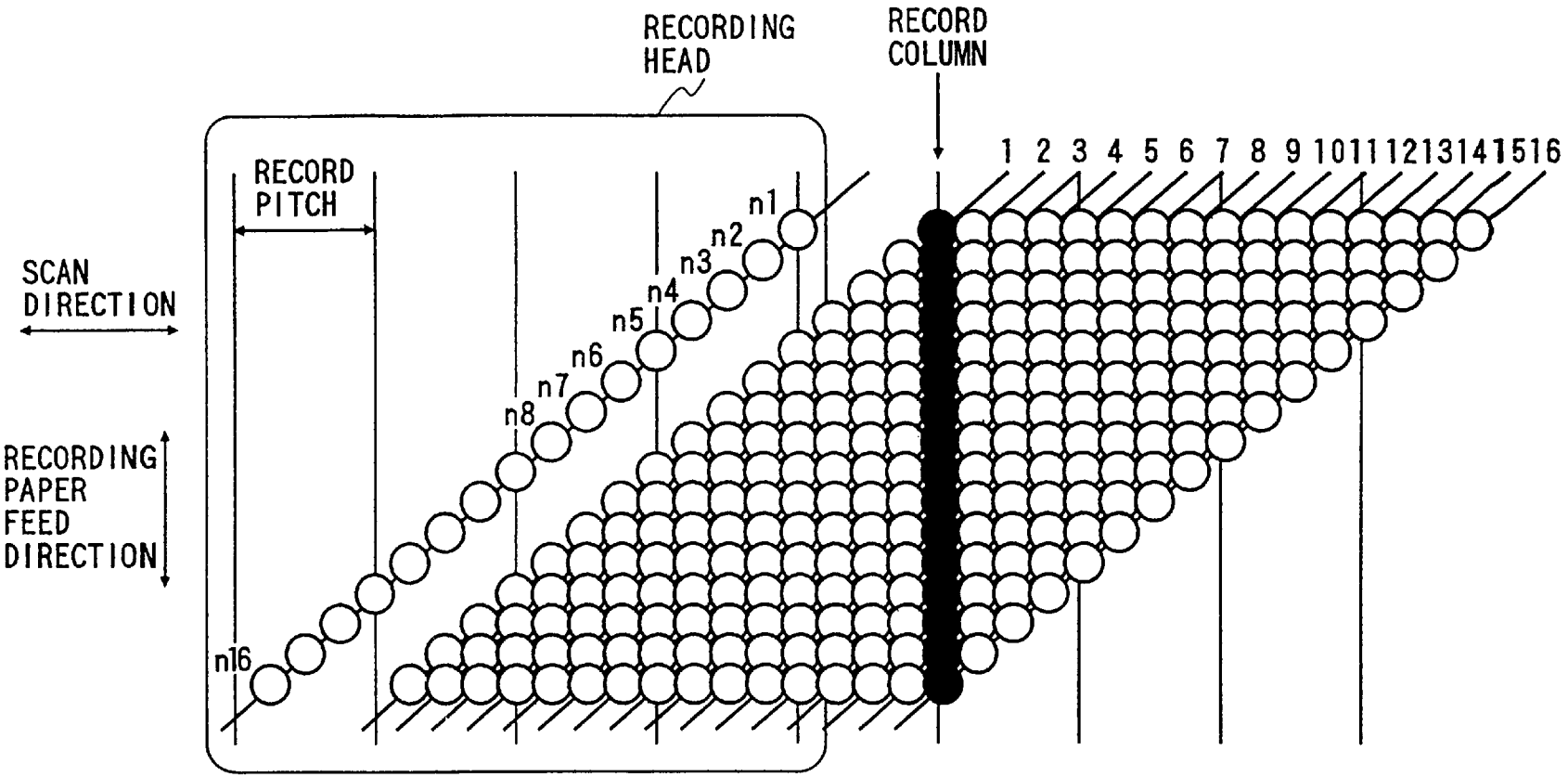
FIG. 11 PRIOR ART
FIG. 11 illustrates block drive control of recording elements in a prior art recording head.
Figure 12:
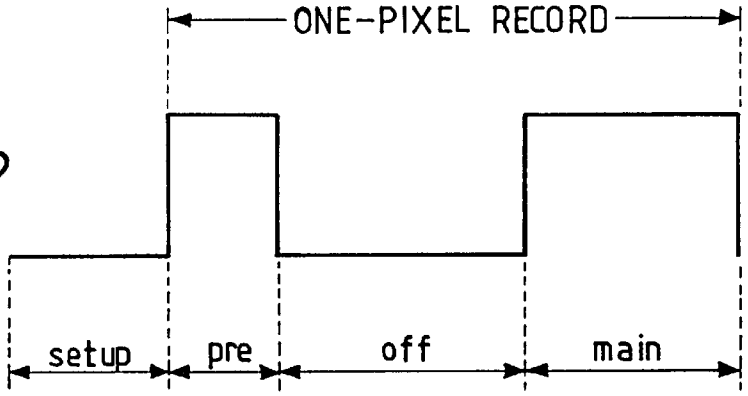
FIG. 12 PRIOR ART
FIG. 12 shows a drive pulse to record one pixel.

While not shown in FIG. 4, the direction of arrangement of the nozzles of the recording head in the present embodiment is oblique to the direction of feed of the recording sheet (medium) as shown in FIG. 11 for the prior art, and the heaters N1 to N16 are provided in the nozzles n1 to n16 as shown in FIG. 11 to heat the ink in the nozzles in accordance with the image data signal so that the ink droplets are discharged from the nozzles n1 to n16.

FIG. 5 shows a relation between the nozzles for discharging the ink droplets and the "H" (high) level block division signals (BENB0, BENB1) and the block sub-division signals (1st, 2nd). According to the relation shown in FIG. 5, when the block division signal BENB0 and the block sub-division signal 1st are at the "H" (high) level, the heaters N1, N5, N9 and N13 are concurrently driven so that the ink droplets are concurrently discharged from the nozzles n1, n5, n9 and n13 and the pixels are concurrently recorded on the recording medium.

Figure 6:
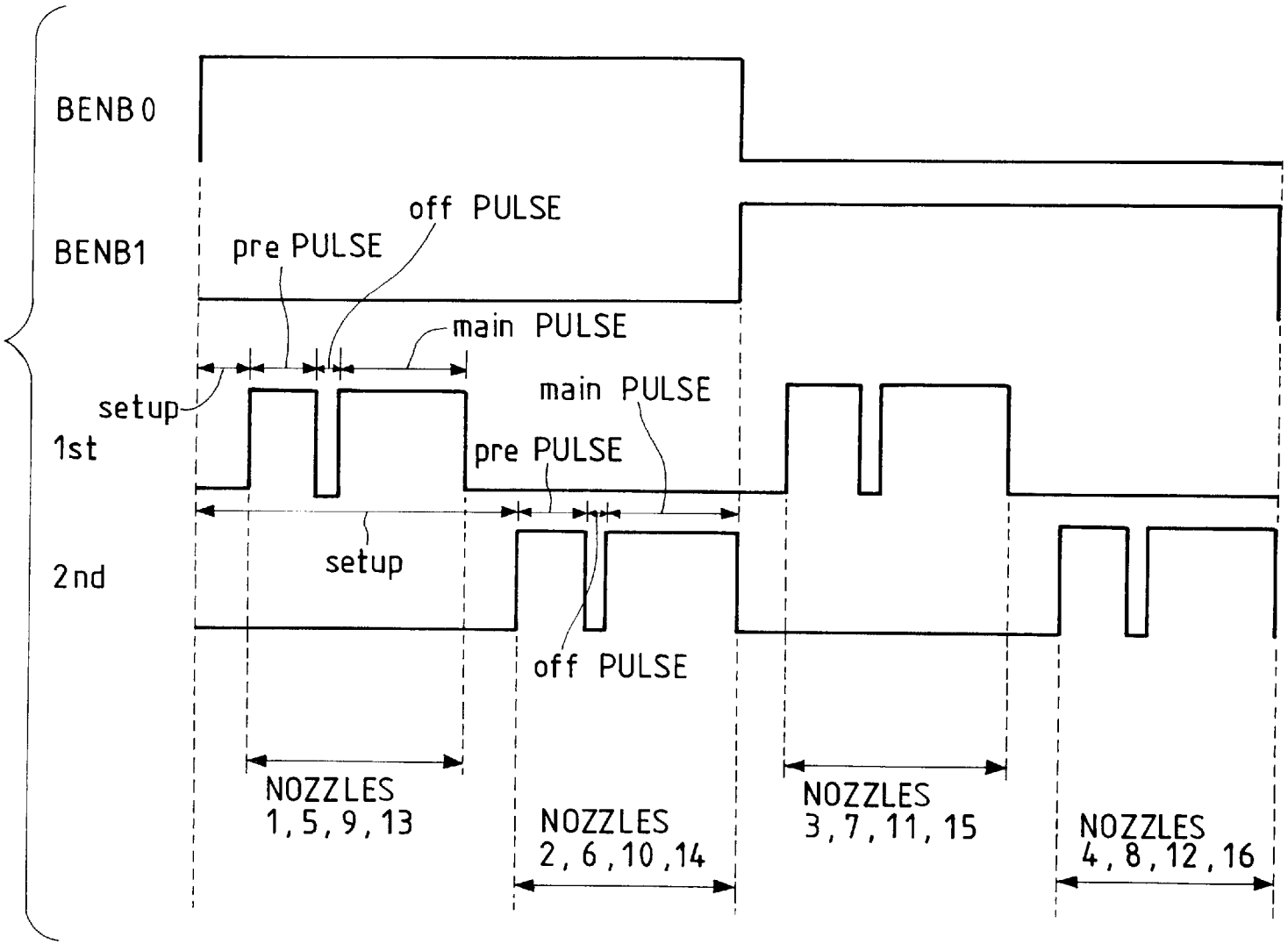
FIG. 6 shows signal characteristics of the block division signals (BENB0, BENB1) and the block sub-division signals (1st, 2nd)
Figure 7:
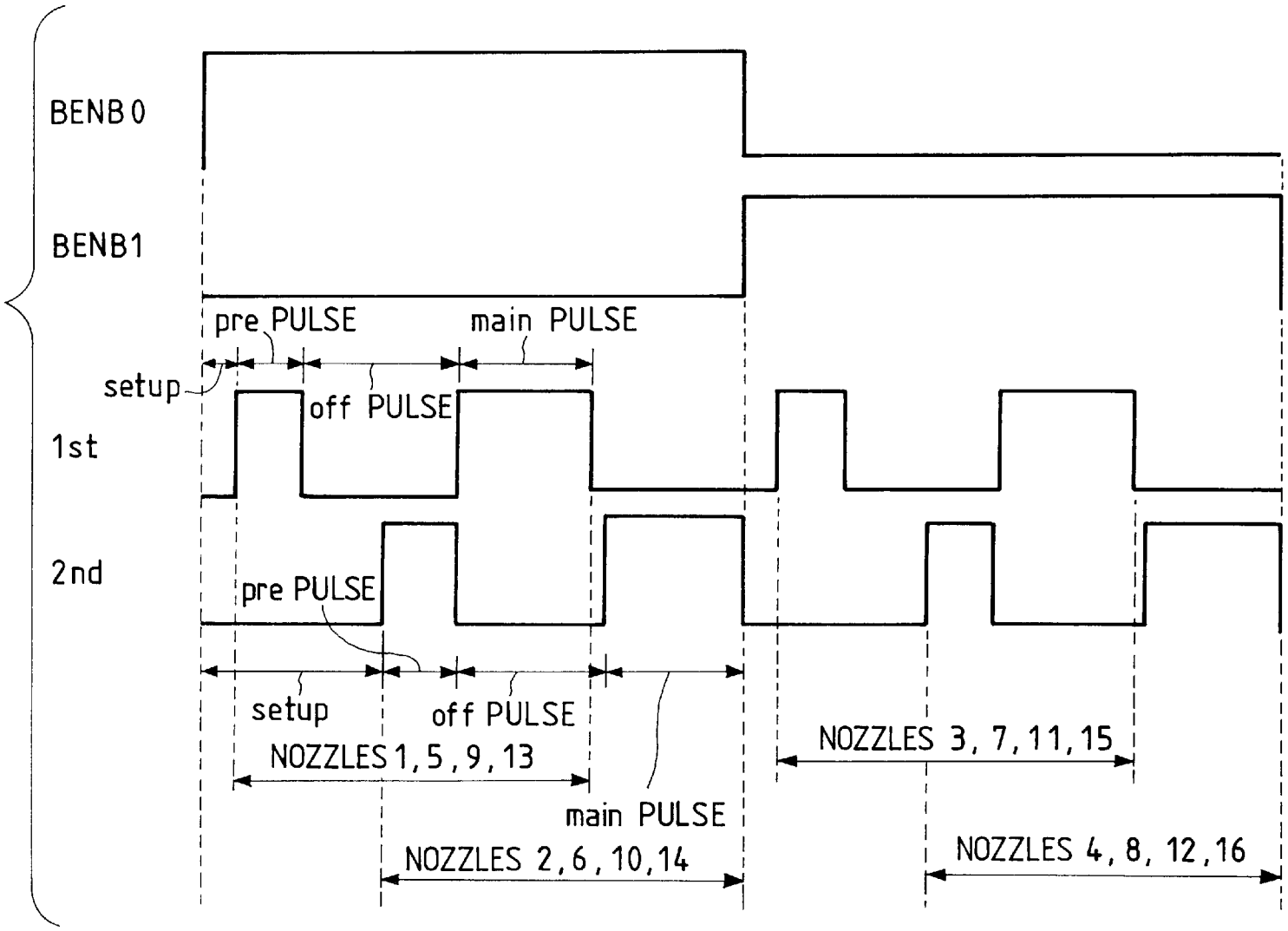
FIG. 7 shows signal characteristics of the block division signals (BENB0, BENB1) and the block sub-division signals (1st, 2nd)

FIGS. 6 and 7 show time transition when the block division signals (BENB0, BENB1) and the block sub-division signals (1st, 2nd) change to the "H" level and the nozzle numbers of the selected recording elements. The two block sub-division signals (1st, 2nd) shown in FIGS. 6 and 7 are double pulses which turn on and off the pulses twice during the "H" level of the block division signal.

As shown in FIG. 6, when the pulse width, which is a total pulse width of a pre-pulse, an off pulse and a main pulse, is short the period divided by two is further divided into two blocks by the block sub-division signal, that is to four blocks in total. Namely, the heaters are driven such that the ink droplets are discharged in different time zones from the group of the nozzles 1, 5, 9 and 13, the group of the nozzles 2, 6, 10 and 14, the group of the nozzles, 3, 7, 11 and 15 and the group of the nozzles 4, 8, 12 and 16. Thus, the control is essentially identical to the 4-block sub-division drive.

On the other hand, as shown in FIG. 7, when the time zone of the off pulse is extended to extend the pulse duration, instead of sub-dividing the blocks divided into two by the block sub-division signal, the drive periods in the block are interlaced. The total ink discharge intervals of the nozzles 1 to 16 does not change but the pulse durations for the group of the nozzles 1, 5, 9 and 13 and the group of the nozzles 2, 6, 10 and 14 are slightly overlapped so that the pulse durations of the respective groups are extended. In this case, the interlace is such that while the group of the nozzles 1, 5, 9 and 13 and the group of the nozzles 3, 7, 11 and 15 are driven by the pre-pulse and the main pulse of the block sub-division signal (1st), the heaters of the group of the nozzles 2, 6, 10 and 14 and the group of the nozzles 4, 8, 12 and 16 are not driven by the pre-pulse and the main pulse of the block sub-division signal (2nd). In this manner, the increase of the load of the power supply is prevented. Namely, even if the off pulse duration is extended, the on durations of the pre-pulse and the main pulse of the block sub-division signal (1st) do not overlap with those of the block sub-division signal (2nd).

In FIGS. 6 and 7, a time period before the rise of the pre-pulse is referred to as setup.

As described above, the recording elements of the recording head are controlled by the four control signals, that is, the block signals (BENB0, BENB1) and the block sub-division signals (1st, 2nd) supplied from the controller provided in the interface 21 shown in FIG. 2.

The pulse width (off time period) shown in FIGS. 6 and 7 may be controlled in accordance with the temperature information (T) derived from the temperature sensor 30 built in the recording head.

Figure 8:
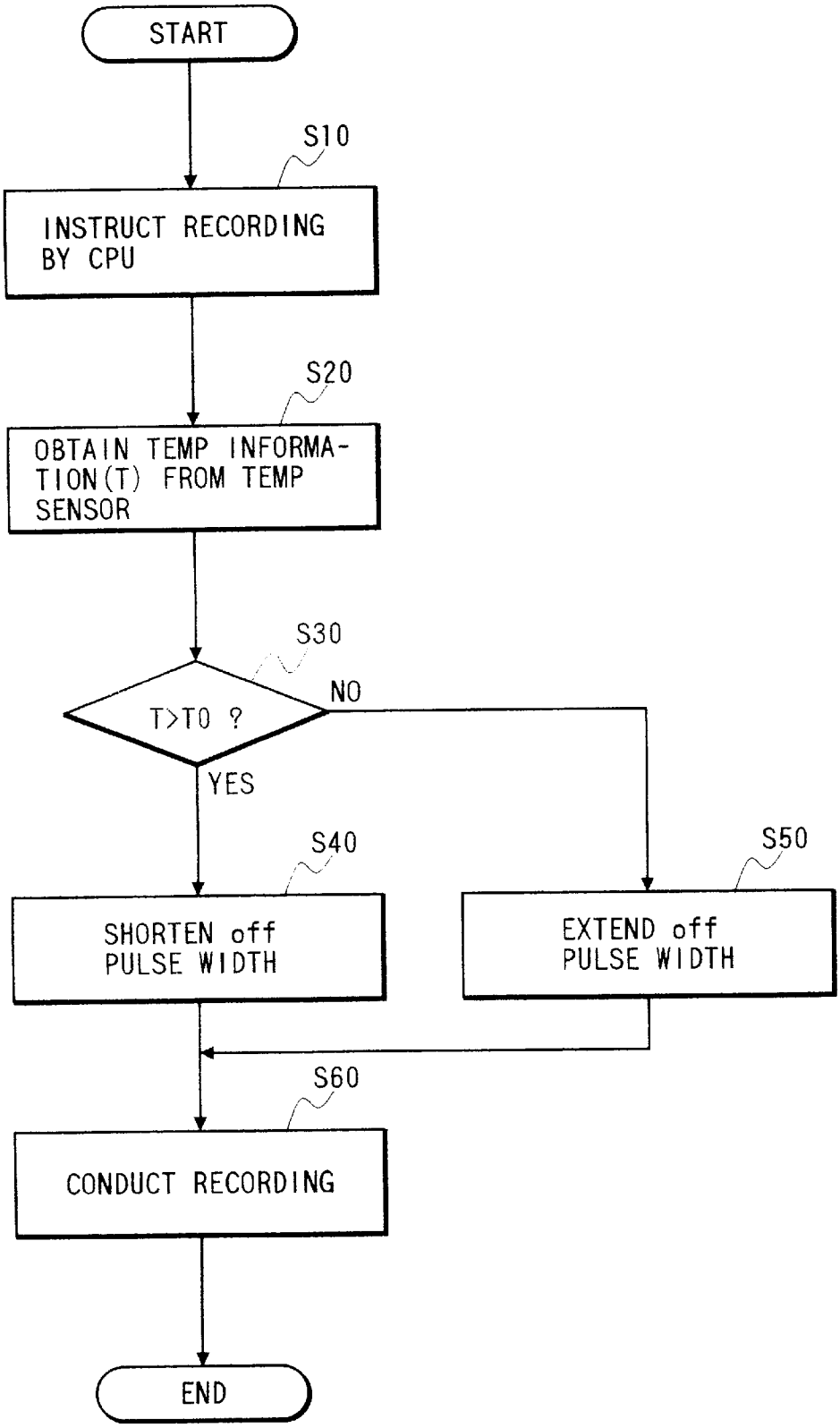
FIG. 8 shows a flow chart of pulse width control in accordance with a first embodiment.

Referring to a flow chart of FIG. 8, the pulse width control is explained in detail.

In a step S10, a record operation command is issued from the CPU and in a step S20, the temperature information (T) is acquired from the temperature sensor in the recording head. Thus, the control circuit may detect the internal temperature of the recording head. In a step S30, the temperature information (T) is compared with a predetermined threshold (T0). If T>T0, the process proceeds to a step S40 where the off pulse width is shortened as shown in FIG. 6. On the other hand, if T≦T0, the process proceeds to a step S50 where the off pulse width is extended as shown in FIG. 7.

In a last step S60, the recording operation is conducted in accordance with the off pulse width adjusted in the step S40 or S50.

By this control, the off pulse width may be extended or the total pulse width may be extended to increase the ink droplet discharge amount and suppress the deterioration of the image grade without extending the total recording time even for the change of the ink droplet discharge amount due to the temperature change where the discharge ink droplet amount is reduced under a low temperature environment.

In accordance with the present embodiment, the energization times of the heaters of the respective groups are controlled such that the energization time of the heaters of one group and the energization time of the heaters of another group are partially overlapped (interlaced) to control the ink droplet discharge amount without extending the total recording time (throughput) by using the block sub-division signal so that the high speed recording is attained while maintaining the high grade record image without being affected by the environmental change of the printer.

Alternatively, the block sub-division signal may be used to essentially increase the number of divided blocks.

In the present embodiment, in order to facilitate the understanding, the number of nozzles is set to 16 although the present invention is not limited thereto. For example, a recording head having 50 to 128 nozzles which is actually mounted in the printer apparatus may be used. The number of divided blocks is also not limited to 4 or 8 but it may be 16 or 32.

In the present embodiment, by simple control the off pulse width is extended or shortened by the single threshold (T0), although the present invention is not limited thereto. For example, the off pulse width may be changed stepwise by a plurality of thresholds or a table, or the off time width may be represented as a function of the temperature information (T) and the off pulse width may be continuously changed in accordance with T. Alternatively, the pre-pulse may be modulated.

Second Embodiment

A control to switch the block division of the recording head in accordance with various recording modes of the printer apparatus is explained.

In the first embodiment, the setup time of the signal 2nd is changed in accordance with the off time pulse width of the two block sub-division signals (1st, 2nd) of the double pulses to essentially increase the number of divided blocks as required or change the energization times of the heaters of the respective divided groups.

On the other hand, in the recording head having the nozzles arranged obliquely to the direction of transfer of the recording sheet (medium) across a plurality of record columns as in the prior art explained with reference to FIG. 11, when the recording operation is to be conducted with the 4-block division as explained in the prior art, the record pixels along the column are arranged linearly by sequentially recording the first nozzle (n1) to the fourth nozzle (n4) at an equal interval.

However, when the pulse width modulation as explained in FIGS. 7, 16A and 16B is conducted to control the heater drive time, the record pixels along the column are principally not linear because the first nozzle (n1) to the fourth nozzle (n4) are not recorded at equal interval in the strict sense. How much shift may be permitted depends on a policy of product design and cannot be generally defined, but basically, it is determined by the trade-off between the demerit of the shift of the record pixels and the merit of free control of the heater drive time without changing the total recording time. In the present embodiment, the recording mode is a factor to determine the trade-off and when the resolution expansion mode is indicated from the console panel 22 as the recording mode, the pulse width control of FIGS. 7, 16A and 16B as explained in the first embodiment is conducted.

Figure 9:
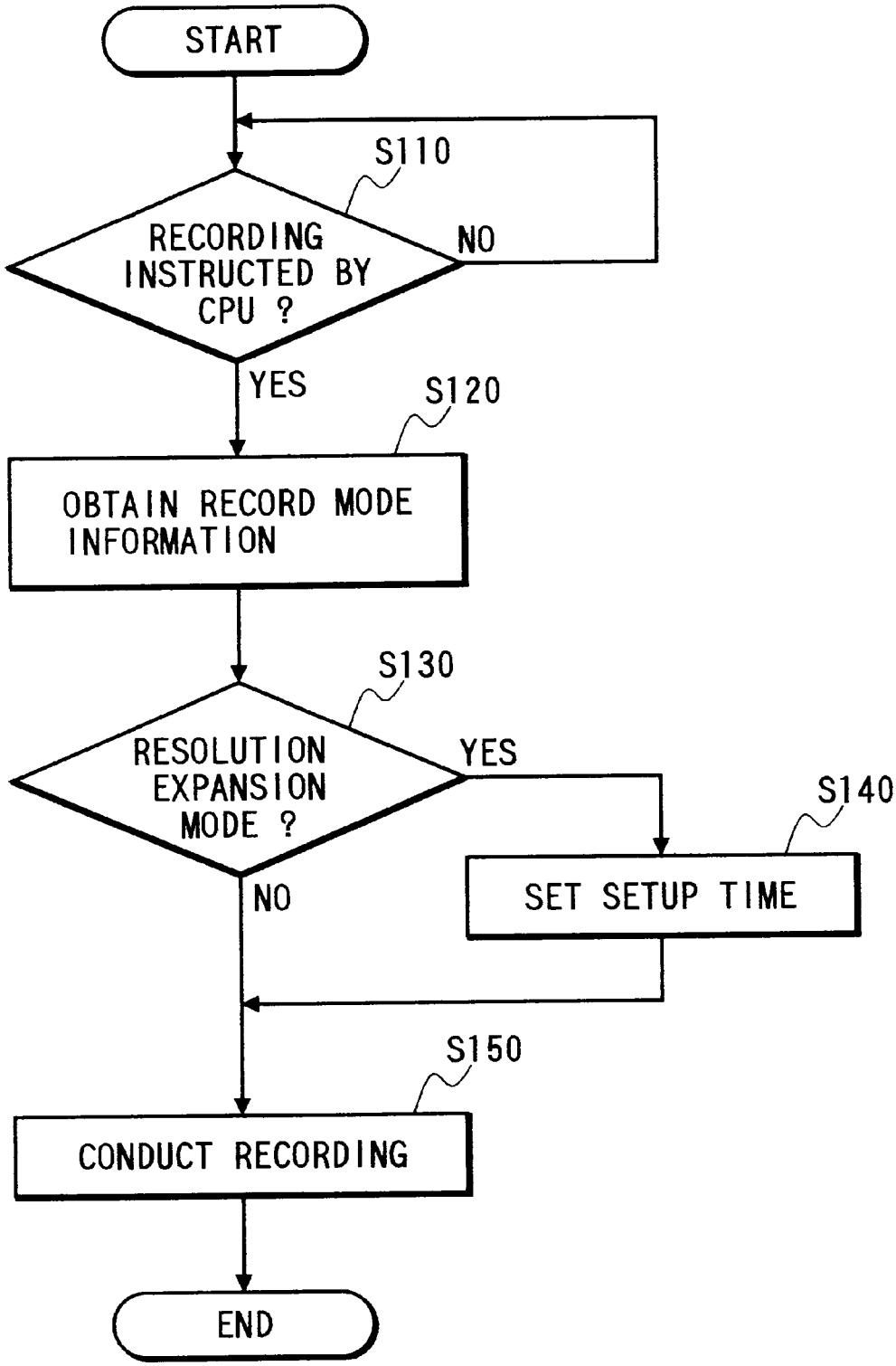
FIG. 9 shows a flow chart of pulse width control in accordance with a second embodiment.

Referring to a flow chart of FIG. 9, the control process of the pulse width in accordance with the present embodiment is explained.

When the apparatus is powered on, the process enters a record stand-by state in a step S110. When a recording operation is commanded by the CPU, the process proceeds to a step S120 to acquire the information on the recording mode.

In a step S130, whether the recording mode is the normal mode or the resolution expansion mode is determined. If the recording mode is the resolution expansion mode, the process proceeds to a step S140 where the setup time is set to conduct the pulse width control in order to enhance the drive frequency as explained in FIGS. 6, 7, 16A and 16B of the first embodiment. On the other hand, when the recording mode is the normal mode, the process proceeds to a step S150. The drive waveform is shown in FIGS. 15A and 15B.

Finally, the process conducts the recording operation with the pulse width controlled and adjusted in the step S150. When the recording operation is completed, the process returns to the record stand-by state unless the apparatus is powered off.

Accordingly, in accordance with the present embodiment, the pulse width is controlled in accordance with the externally commanded recording mode and the pulse width for driving the optimum heaters for the recording mode is produced. In the present embodiment, when the recording operation is conducted by expanding the resolution, the sufficient heater drive time is attained without changing the total recording time so that the high grade image may be recorded while maintaining the high recording speed.

In the present embodiment, the pulse width control by the internal temperature of the recording head as explained in the first embodiment was not described although such control may be added to the process of the present embodiment.

In the present embodiment and the first embodiment, the control to change the off pulse width has been described as the pulse width control although the present invention is not limited thereto. For example, the pre-pulse width may be modulated, or after the pulse width of the block sub-division signal (1st) is determined, the width of the setup of the succeeding block sub-division signal (2nd) may be adjusted. In this case, when the off pulse width of the block sub-division signal (1st) is shorter than the pre-pulse width of the block sub-division signal (2nd), that is, if the pulse width which is the total width of the pre-pulse width, the off pulse width and the main pulse width is short, the number of divided blocks may be large and the heaters may be sequentially driven for each block as shown in FIG. 6. This may be readily attained by adjusting the width of the setup of the block sub-division signal (2nd).

Third Embodiment

In the present embodiment, a plurality of sets of information for defining characteristics of the block sub-division signals (1st and 2nd) of the double pulses is stored in the control circuit in a form of table and block sub-distributions signals (1st, 2nd) of an optimum characteristic to the operating environment in which the printer is placed is selected from the table to conduct the recording operation. As the information for defining the characteristics of the block sub-division signals (1st, 2nd), the setup time of the block sub-division signal (1st), the setup time of the block sub-division time (2nd) and the pre-pulse width, the off pulse width and the main pulse width which are common to the block sub-division signals (1st, 2nd) are considered.

Figure 13:
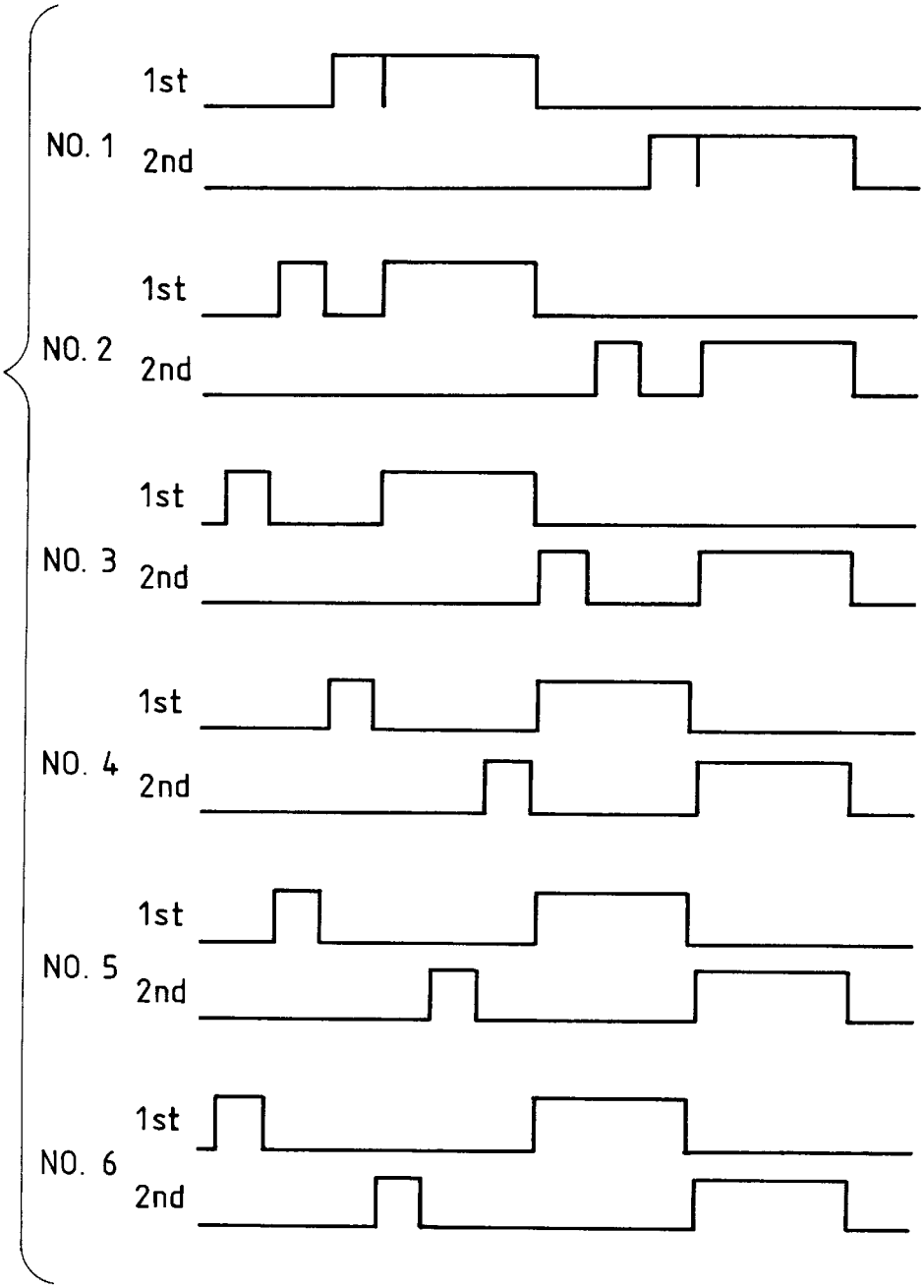
FIG. 13 shows a timing of the signal characteristic shown in FIG. 10.

FIG. 10 shows specific values for that information and FIG. 13 shows a timing thereof. Six cases are shown. A recording head of 128 nozzles is assumed and the permissible number of concurrently driven nozzles is 8, the drive frequency is 200 μs, the total pulse width (pre-pulse width+main pulse width) of the current supply time in the drive pulse width is 4 μs, the pre-pulse width is 1 μs, the main pulse width is 3 μs, the number of divided blocks in the normal mode is 16 and the drive time width per block is 12.5 μs.

In FIG. 13, in case No. 1, the off pulse width is "0" and it is essentially a single pulse. In case No. 2 and case No. 3, the pulse width (total of the pre-pulse width, the off pulse width and the main pulse width) of the two signals, the block sub-division signals (1st, 2nd) is independent in time, that is, the pulse width control is conducted to increase the number of divided blocks (respective blocks are sequentially driven). In cases No. 4 to No. 6, the pulse width control is conducted such that the two signals of the block sub-division signals (1st, 2nd) overlap (the drive time zones of the respective blocks overlap). A difference between the cases No. 2 and No. 3 and the cases No. 4 to No. 6 is due to the dependency on the relation between the setup time of the block sub-division signal (2nd) and the total pulse width of the setup time, the pre-pulse width, the off pulse width and the main pulse width of the block subdivision signal (1st).

By conducting the pulse width control for the cases No. 1 to No. 3 including the single pulse, the recording elements in each group are sequentially driven for recording and the precision of alignment of dots is enhanced.

Accordingly, by applying the information of the pulse width control as shown in FIG. 10 to the pulse width control which depends on the internal temperature of the recording head explained in the first embodiment and the pulse width control which depends on the recording mode explained in the second embodiment, the pulse width controls optimum to the respective conditions are attained. For example, when the recording mode is the normal mode, the pulse width control of the cases No. 1 to No. 3 is conducted, and when the recording mode is the resolution expansion mode, the pulse width control of the cases No. 4 to No. 6 is conducted. Further, in the normal mode, the signal characteristics of the block sub-division signals (1st, 2nd) used to control the pulse width is changed to cases No. 1→No. 2→No. 3 in accordance with the internal temperature of the recording head derived from the temperature sensor 30, and in the resolution expansion mode, the signal characteristics of the block sub-division signals (1st, 2nd) used to control the pulse width is changed to cases No. 4→No. 5→No. 6.

In accordance with the present embodiment, the plurality of sets of information to define the characteristics of the block sub-division signals (1st, 2nd) are stored in the table so that the block sub-division signals (1st, 2nd) having the optimum characteristics may be readily selected from the table in accordance with the operation environment in which the printer or the recording head is placed or the command from the console panel to conduct the recording operation.

In the present embodiment, the pre-pulse width, the off pulse width and the main pulse width are common to the block sub-division signals (1st, 2nd) although the pre-pulse width, the off pulse width and the main pulse width may be different for each of the signals (1st, 2nd) and the drive pulses may be modulated in accordance with the difference between nozzles for each division group of the recording head.

The present invention is particularly suitable for use in an ink jet recording head and a recording apparatus in which an electro-thermal transducer, a laser beam or the like is used to cause a change of state of the ink to eject or discharge the ink, because the high density of pixels and high resolution of recording are attained.

The typical construction and the operational principles are preferably the ones disclosed in U.S. Pat. No. 4,723,129 and U.S. Pat. No. 4,740,796. The principle and the structure are applicable to a so-called on-demand type recording system and a continuous type recording system. Particularly, however, it is suitable for the on-demand type because the principle is such that at least one driving signal is applied to an electro-thermal transducer disposed on a liquid (ink) retaining sheet or liquid passage, the driving signal being large enough to provide such a quick temperature rise beyond a departure from nucleation boiling point, by which the thermal energy is provided by the electro-thermal transducer to produce film boiling on the heating portion of the recording head, whereby a bubble can be formed in the liquid (ink) corresponding to each of the driving signals. By the generation, development and contraction of the bubbles, the liquid (ink) is ejected through a discharge port to produce at least one droplet. The driving signal is preferably in the form of pulse because the development and the contraction of the bubbles can be effected instantaneously, and therefore the liquid (ink) is ejected with fast response. The driving signal is preferably such as those disclosed in U.S. Pat. No. 4,463,359 and U.S. Pat. No. 4,345,262. In addition, the temperature rise rate of the heating surface is preferably such as those disclosed in U.S. Pat. No. 4,313,124.

The structure of the recording head may be those shown in U.S. Pat. No. 4,558,333 and U.S. Pat. No. 4,459,600 in which the heating portion is disposed at a bent portion, as well as the structure of the combination of the ejection outlet, liquid passage and the electro-thermal transducer disclosed in the above-mentioned patents. In addition, the present invention is applicable to the structure disclosed in Japanese Laid-Open Patent Application No. 59-123670 in which a common slit is used as the discharge port for a plurality of electro-thermal transducers, and the structure disclosed in Japanese Laid-Open Patent Application No. 59-138461 in which an opening for absorbing a pressure wave of thermal energy is formed corresponding to the discharge port. This is because the present invention is effective to perform the recording with certainty and high efficiency irrespective of the type of the recording head.

In addition, the present invention is applicable to a serial type recording head in which the recording head is fixed on a main assembly, to a replaceable chip type recording head which is connected electrically with the apparatus and can be supplied with the ink when it is mounted in the main assembly, or to a cartridge type recording head having an integral ink container.

The provisions of the recovery means and/or the auxiliary means for the preliminary operation are preferable because they further stabilize the effects of the present invention. As for such means, there are capping means for the recording head, cleaning means therefor, pressurizing or suction means, preliminary heating means which may be an electro-thermal transducer, an additional heating element or a combination thereof. Also, means for effecting preliminary discharge (not for the recording) may stabilize the recording operation.

As regards the variation of the recording head mountable, it may be a single head for a single color or plural heads for a plurality of inks having different colors or densities. The present invention is effectively applicable to an apparatus having at least one of a monochromatic mode mainly with black, a multi-color mode with different color inks and/or a full color mode using the mixture of colors, which may be an integrally formed recording unit or a combination of a plurality of recording heads.

Furthermore, in the foregoing embodiment, the ink is liquid. Alternatively, ink which is solidified below a room temperature and liquefied at a room temperature may be used. Since the ink is controlled within a temperature range of not lower than 30° C. and not higher than 70° C. to stabilize the viscosity of the ink to provide the stable discharge in a conventional recording apparatus of this type, the ink may be such that it is liquid within the temperature range when the recording signal is applied. The present invention is applicable to other types of ink. In one of them, the temperature rise due to the thermal energy is positively prevented by consuming it for the state change of the ink from the solid state to the liquid state. Another ink is solidified when it is left, unused, to prevent the evaporation of the ink. In any case, upon the application of the recording signal producing thermal energy, the ink is liquefied, and the liquefied ink may be discharged. Another ink may start to be solidified at the time when it reaches the recording sheet.

The present invention is also applicable to the ink which is liquefied by the application of the thermal energy. Such ink may be retained in liquid state or solid state in holes or recesses formed in a porous sheet as disclosed in Japanese Laid-Open Patent Application No. 54-56847 and Japanese Laid-Open Patent Application No. 60-71260. The sheet is faced to the electro-thermal transducers. The most effective one of the inks described above is the film boiling system.

The ink jet recording apparatus may be used as an output terminal of an information processing apparatus such as a computer or the like, as a copying machine combined with an image reader or the like, or as a facsimile machine having information sending and receiving functions.

In accordance with the present invention, even if the change in the operating environment of the recording apparatus which affects the operation of the recording head is involved, the total recording speed of the apparatus is not affected and the recording elements are energized by the proper pulse control signals for recording the image so that the recording image grade is maintained high.

Further, in accordance with the present invention, even if the operating temperature of the recording apparatus or the recording density of the image recording changes, it does not affect the total recording speed of the apparatus and the recording elements are energized by the proper pulse control signals and the record image grade is maintained high.

In accordance with the present invention, since the specification of the block division may be readily changed in accordance with the print mode, the high speed image recording and the high image grade are compatible.

In accordance with the present invention, even if the specification of the block division is changed, the number of concurrently driven recording elements can be increased without increasing the drive load.

While the invention has been described with reference to the structures disclosed herein, it is not confined to the details set forth and the present invention is intended to cover such modifications or changes as may come within the objects of the improvements or the scope of the claims.

What is claimed is:

1. A recording apparatus for recording an image on a recording medium using a recording head having a plurality of recording elements divided into a plurality of blocks, comprising:

division means for dividing each block into sub-periods; and drive means for driving the recording elements of each block so that the recording elements associated with a given sub-period of a block are driven substantially concurrently and the recording elements associated with different sub-periods of the same block are driven at different timings, with said division means being capable of dividing said blocks using a plurality of different division arrangements, with the sub-periods obtained using different division arrangements not overlapping one another.

2. A recording apparatus according to claim 1, wherein said division means controls changing of the divided sub-periods and interlacing of the sub-periods to prevent a total period of the blocks from being changed when the divided sub-periods change.

3. A recording apparatus according to claim 2, further comprising:

measurement means for measuring a temperature of said recording head, wherein said division means changes the divided sub-periods in accordance with the temperature of said recording head measured by said measurement means.

4. A recording apparatus according to claim 1, wherein said recording head comprises an ink jet recording head for recording by discharging ink.

5. A recording apparatus according to claim 1, wherein said recording head comprises a recording head for discharging ink by utilizing thermal energy and has a thermal energy transducer for generating the thermal energy to be applied to the ink.

6. A recording apparatus according to claim 2, further comprising:

indication means for indicating a recording density, wherein said division means changes the divided periods in accordance with the recording density indicated by said indication means.

7. A recording apparatus according to claim 6, further comprising:

memory means for storing information defining signal characteristics of the divided sub-period, wherein said division means selects the information to attain an optimum signal characteristic of the divided sub-period from said memory means to control change of the pulse widths of the divided sub-periods by the selected information.

8. A recording apparatus according to claim 2, wherein the divided periods include double pulse signals each having a first pulse, an off-pulse state following said first pulse and a second pulse following said off-pulse state, and the divided sub-period is a sum of a width of said first pulse, a width of said off-pulse state and a width of said second pulse.

9. A recording apparatus according to claim 8, wherein said division means changes the width of said off-pulse state to change the width of said divided period.

10. A recording apparatus according to claim 8, wherein said division means controls to prevent the overlap of the on time of said first and second pulses of a first block of the plurality of blocks and the on time of said first and second pulses of a second block.

11. A recording apparatus according to claim 1, further comprising a carriage for removably mounting said recording head.

12. A recording apparatus according to claim 1, further comprising feed means for feeding a recording medium to be recorded by said recording head.

13. A recording apparatus according to claim 1, wherein said recording apparatus is applied to a copying apparatus.

14. A recording apparatus according to claim 1, wherein said recording apparatus is applied to a facsimile apparatus.

15. A recording apparatus according to claim 1, wherein said recording apparatus is applied to a computer terminal.

16. A method of recording an image on a recording medium using a recording head having a plurality of recording elements divided into a plurality of blocks, said method comprising the steps of:

dividing each block into sub-periods using a plurality of different division arrangements, with the sub-periods obtained using different division arrangements not overlapping one another; and driving the recording elements of each block so that the recording elements associated with a given sub-period of a block are driven substantially concurrently and the recording elements associated with different sub-periods of the same block are driven with different timings.

17. A recording method according to claim 16 wherein said dividing step controls changing of the divided sub-periods and interlacing of the sub-periods to prevent a total sub-period of the blocks from being changed when the divided sub-periods change.

* * * * *

UNITED STATES PATENT AND TRADEMARK OFFICE

CERTIFICATE OF CORRECTION

PATENT NO. : 6,019,448
DATED : February 1, 2000
INVENTOR(S) : Yano et al.

It is certified that error appears in the above-identified patent and that said Letters Patent is hereby corrected as shown below:

Column 1,
Line 11, “Office Automation” should read -- Automated office --; and
Line 12, “popular widely” should read -- widely popular --.

Column 2,
Line 22, “to” should read -- with --.

Column 4,
Line 59, “to each” should read -- each --.

Column 15,
Line 12, “Arecording” should read -- A recording --.

Column 16,
Line 22, “claim 16” should read -- claim 16, --.

Signed and Sealed this

Nineteenth Day of August, 2003

JAMES E. ROGAN
*Director of the United States Patent and Trademark Office*